United States Patent [19]

Stifelman

[11] Patent Number: 4,480,160

[45] Date of Patent: Oct. 30, 1984

[54] DIFFERENTIAL PRESSURE SWITCH

[75] Inventor: Jack Stifelman, Minneapolis, Minn.

[73] Assignee: Donaldson Company, Inc., Minneapolis, Minn.

[21] Appl. No.: 413,550

[22] Filed: Aug. 31, 1982

[51] Int. Cl.[3] ..... H01H 35/38

[52] U.S. Cl. ..... 200/82 R; 200/82 D

[58] Field of Search ..... 200/61.04, 61.53, 81.9 R, 200/81 R, 82 R, 82 B, 82 D; 340/606, 607, 611

[56] References Cited

U.S. PATENT DOCUMENTS

| | | | |
|---|---|---|---|
| 2,251,648 | 8/1941 | Wayman | 200/82 D |
| 2,772,409 | 11/1956 | Reid | 200/81.9 R |
| 2,810,034 | 10/1957 | Grant | 200/81.9 |
| 2,826,754 | 3/1958 | Carignan | 340/608 |
| 2,879,892 | 3/1959 | Frakes | 210/90 |
| 3,239,625 | 3/1966 | Clason | 200/81.9 R |
| 3,644,915 | 2/1972 | McBurnett | 340/607 |
| 3,654,414 | 4/1972 | Kudlaty | 200/308 |
| 3,780,243 | 12/1973 | Koomey et al. | 200/82 R |

*Primary Examiner*—J. R. Scott

*Attorney, Agent, or Firm*—Merchant, Gould, Smith, Edell, Welter & Schmidt

[57] ABSTRACT

A differential pressure switch is disclosed. The switch functions through a conductive path formed within the fluid of a single cavity of a housing having passages for communicating high and low pressure fluid to the cavity. The switch has a cantilevered post with movable conducting and nonconducting members mounted thereabout and being movable between conductive and nonconductive states according to the differential pressure within the cavity. One of the movable members provides sealing between the post and the cavity wall to separate the high and low pressure fluids.

20 Claims, 8 Drawing Figures

DIFFERENTIAL PRESSURE SWITCH

TECHNICAL FIELD

This invention relates to a differential pressure switch which makes or breaks electrical contact within a chamber having two fluids at different pressures.

BACKGROUND OF THE INVENTION

Although applicable to a number of fields, the present invention was conceived relative to providing a low cost, in-oil switch for an hydraulic oil filter. It is common knowledge that such filters are provided with a filtering element through which oil is forced under pressure from a pump. Periodic replacement of the filter element is necessary because it becomes plugged or clogged with foreign matter removed from the oil. Failure to attend to such replacement can cause serious damage due to contamination.

Signal devices for alerting an operator to the plugged or clogged condition are known. Such devices commonly provide for movement of a magnet or conductor which is then sensed. For example, U.S. Pat. No. 3,654,414 shows a piston moveable by a higher pressure fluid which in turn moves a finger between a pair of switch arms thereby making or breaking a circuit. The problem is that the switch requires a pressure chamber for operation of the piston and a switch housing wherein the finger member operates a switch. Similar signaling devices provide for movement of a magnet which is then sensed by a separate device.

Another category of indicators operates in conjunction with a by-pass valve. For example, U.S. Pat. No. 3,644,915 shows a terminal connected through a spring to a valve element which is in contact with the valve housing to complete a circuit. Movement of the valve element breaks the conductive path. In addition to the various fluid communication channels, the device requires hardware for connection through a wall to make electrical connection with the spring. U.S. Pat. No. 2,879,892 shows a somewhat similar device which does not need the electrical connection through the valve wall, but does require an additional chamber for operation of the valve element. Although bypass valve signaling mechanisms can have a purpose of providing a warning when a filter becomes plugged or clogged, the mechanism is primarily a valve with electrical attachments, as needed. These devices are often less desirable for signaling purposes than switch devices not having a valve function since valve operation is required for signaling, resulting simultaneously in the bypass of the filter element. It is more desirable to signal before the bypass element opens so the filter element can be changed to avoid the need for bypass.

Thus, known art shows switch devices more complex than desirable, and bypass devices providing valve function which may be inappropriate for many applications.

SUMMARY OF THE INVENTION

The present invention, on the other hand, is directed to a differential pressure switch for installation in the single cavity of a grounded housing. The housing includes a mechanism for communicating high and low pressure fluid into the cavity. The switch includes a central post for connection to an electrical energy source. The switch further includes a mechanism for sealably fastening the post to the housing. The fastening mechanism provides support to cantilever an end of the post within the cavity. Connecting mechanism, guided along the cantilevered portion of the post, electrically connects the post and the housing. At the same time, the connecting mechanism includes a mechanism for separating the high and low pressure fluids in the cavity.

Thus, the present invention advantageously eliminates any need for secondary housings or elements for sensing or switching when an element within a pressure chamber is moved or otherwise caused to change state.

Additionally, the present switch provides the capability for signaling without altering the operation like, for example, a bypass valve, of an oil filter or any other device with which it may be used.

The present invention is advantageously constructed about its central post and, consequently, may be readily installed and removed from a cavity into which high and low pressure fluid is directed.

These advantages and other objects obtained by the use of this invention are further explained and may be better understood by reference to the drawings which form a further part of this disclosure and to the descriptive matter thereafter wherein a preferred embodiment is discussed in detail.

DETAILED DESCRIPTION OF THE PREFERRED EMBODIMENT

Figure 1:
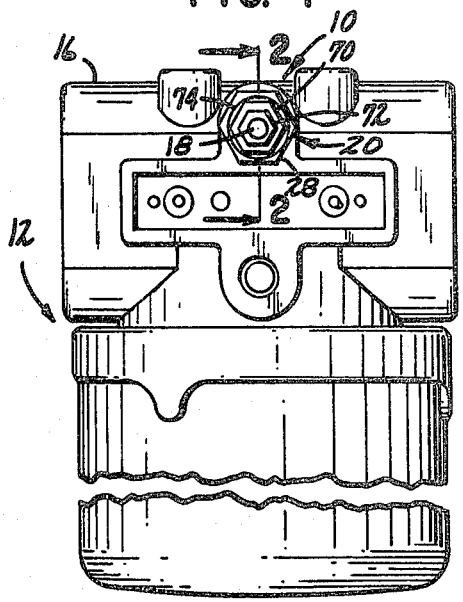
FIG. 1 is a side view of an oil filter in which a switch in accordance with the present invention is installed.

Referring now to the drawings, wherein like reference numberals designate identical or corresponding parts throughout the several views and, more particularly, to FIG. 1, a differential pressure switch in accordance with the present invention is designated generally as 10. Switch 10 is shown in a common application wherein it is installed in an oil filter 12.

Figure 2:
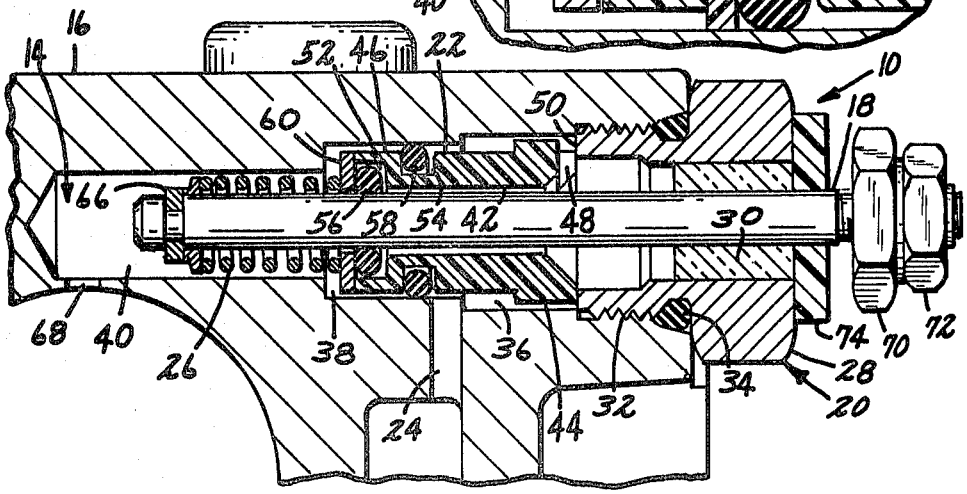
FIG. 2 is a cross-sectional view taken along line 2—2 showing the switch in a cavity.

A preferred embodiment of switch 10 is shown more clearly in FIG. 2 installed in cavity 14 bored or otherwise formed in the housing 16 of filter 12. Switch 10 includes a terminal post 18 with support mechanism 20 for fastening post 18 to housing 16 while an end portion of post 18 extends into cavity 14. A piston 22 slideably moves on post 18 and is biased against high pressure fluid entering cavity 14 through passage 24 by spring 26.

More particularly, support mechanism 20 includes a threaded nut 28 concentrically fastened about post 18 with molded glass 30. Threaded nut 28 is made of a conductive material and separated from terminal post 18, also conductive, by the insulating glass material 30. The outer end of cavity 14 is similarly threaded at 32 to receive threaded nut 28. O-ring 34 provides a seal between nut 28 and housing 16.

Preferably, cavity 14 has four distinct portions. The outermost portion is threaded at 32 as indicated previously. The next outermost portion 36 is unthreaded but has the same diameter as threaded portion 32. Sealing portion 38 has a somewhat smaller diameter than portion 36 while innermost portion 40 has the smallest diameter.

Figure 5:
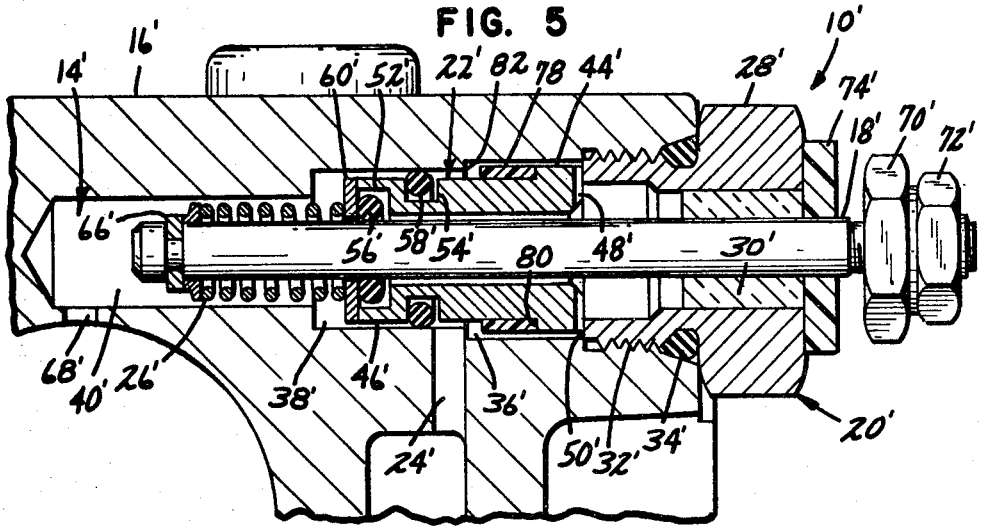
FIG. 5 is a cross-sectional view similar to FIG. 2 showing an alternate embodiment switch.

Piston 22 is cylindrical with an opening 42 through which post 18 passes. Piston 22 has a larger outer diameter portion 44 for moving within unthreaded cavity portion 36 and a smaller diameter portion 46 for moving within sealing portion 38 of cavity 14. Since it is crucial that piston 22 not bind, there is preferably more annular space between piston 22 and the wall of cavity 14 than between piston 22 and post 18. The end of piston 22 facing nut 28 has a plurality of slots 48 extending across the cylindrical wall to opening 42. Slots 48 allow pressure to equalize between opening 42 and unthreaded portion 36 of cavity 14. Slots 48 may be pronounced grooves, knurls or perhaps passages through the wall of piston 22. The larger diameter portion 44 of piston 22 has a diameter sufficient to allow piston 22 to contact the inner end 50 of nut 28. Since such contact for the embodiment of FIG. 5 is conductive, it is necessary that insulating glass 30 not extend to inner end 50 of nut 28.

Figure 3:
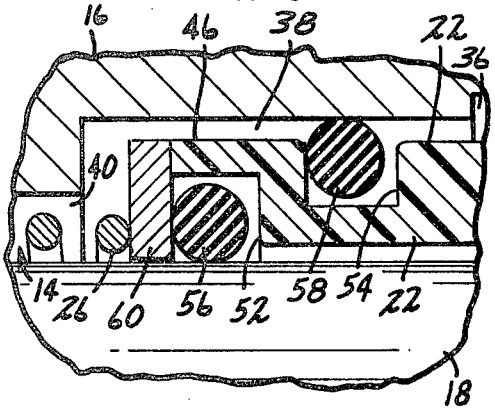
FIG. 3 is a cross-sectional detail of the sealing mechanism.

Near its end opposite slots 48, piston 22 includes inner and outer glands 52, 54 for receipt of seals 56, 58. The sealing mechanism is more clearly shown in FIG. 3 with an alternate embodiment shown in FIG. 4. It is preferable that one of glands 52, 54 is at the end of piston 22 to allow ring 60 to form one side of gland 52. In FIG. 3, seals 56, 58 are O-rings which preferably float within glands 52, 54. That is, the O-rings are not compressed, but rather fit snugly against a wall to function more like a wiper. Fluid on the higher pressure side of the O-rings forces them to seal against the opposite gland side wall. Thus, O-ring 56 which seals on post 18 provides sealing contact on post 18 and along a surface of ring 60. O-ring 58 provides sealing contact along the wall of sealing portion 38 of cavity 14 and against the wall of gland 54 nearer the low pressure fluid. In this fashion, seals 56, 58 separate the high and low pressure fluids within cavity 14.

Figure 4:
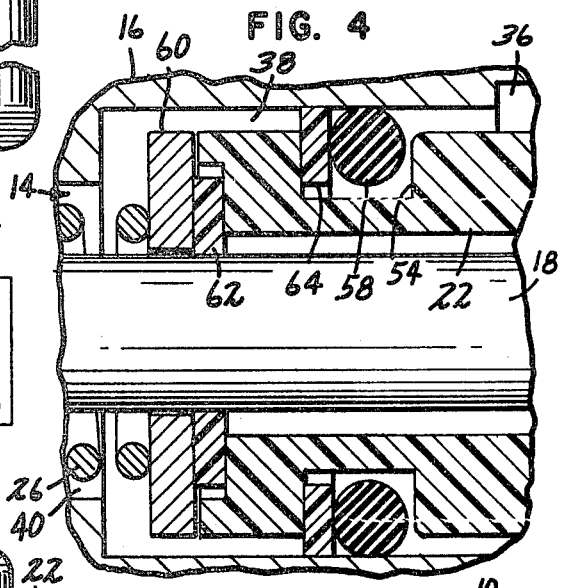
FIG. 4 is a cross-sectional detail of an alternate sealing mechanism.

In the embodiment of FIG. 4, O-ring 56 is replaced with a ring 62. Ring 64 may replace O-ring 58 or be used as a backup ring by being installed on the low pressure side of O-ring 58, as shown. Ring 62 is in sealing contact with post 18 while ring 64 is in sealing contact with the wall of sealing portion 38 of cavity 14. It has been found that when rings 62 and 64 are made from Teflon or a similar material, that piston 22 may be moved with a much smaller pressure differential between the two fluids and thus, that switch 10 is more sensitive to a lesser difference in pressures. Note, too, that since the seals of either type function much like wipers, that the glands need not have critical tolerances thereby allowing the piston to be molded or otherwise inexpensively formed.

Coil spring 26 is compressed between ring 6 and a clip 66 functioning as a stop near the cantilevered end of post 18.

Differential pressure switch 10 in the embodiment of FIG. 2 is normally open. Low pressure fluid through passage 68 fills inner portion 40 and part of sealing portion 38 of cavity 14. The rest of cavity 14 is filled with a higher pressure fluid through passage 24. Until overcome by the high pressure fluid, spring 26 holds piston 22 against end 50 of nut 28.

Post 18 is electrically connected to a power source in a usual fashion, for example, by inserting a lug between nuts 70, 72 at the outside threaded end of post 18. Insulator 74 prevents contact between nut 70 and nut 28. Housing 16 is grounded. In the normally open switch 10 of FIG. 2, piston 22 is made of a non-conductive material so that closure of a circuit path occurs when ring 60 contacts the wall 76 between sealing portion 38 and innermost portion 40 of cavity 14. With clip 66, spring 26 and ring 60 made of conductive materials, when the higher pressure fluid overcomes spring 26 to move piston 22 so that ring 60 contacts wall 76, a conductive path is completed between post 18 and housing 16 through clip 66, spring 26 and ring 60. Thus, in the case of the filter such as 12, when its resistance to fluid flow is such as to increase fluid pressure in communication with passage 24 to a level which overcomes spring 26, switch 10 changes state and through an external circuit, provides the desired signal.

A normally closed switch 10′ is shown in the alternate embodiment of FIG. 5. Many of the various elements are the same as those shown in FIG. 2. For the sake of comparison, the elements of FIG. 5 are numbered the same as similar elements in FIG. 2 but are primed to distinguish one embodiment from the other. One difference between the two embodiments is that piston 22′ is made of conductive material. Thus, with spring 26′ forcing piston 22′ against nut 28′, a conductive path is completed between post 18′ and housing 16′ through clip 66′, spring 26′, ring 60′, piston 22′ and nut 28′. A further difference between the two embodiments is that an insulator 78 is shaped cylindrically to fit about the smaller diameter portion of piston 22′ in the region of unthreaded portion 36′ of cavity 14′. Insulator 78 has length such that when it contacts shoulder 80 between the larger and smaller diameters of piston 22′, insulator 78 stops the movement of piston 22′ before ring 60′ contacts surface 76′. This prevents the circuit from closing as differential pressure increases.

Figure 8:
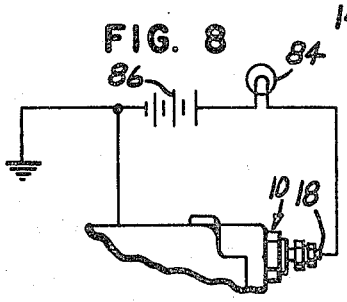
FIG. 8 is a schematic diagram of a typical circuit using a switch in accordance with the present invention.

To use either switch embodiment, a cavity 14 is bored in an appropriate housing such that a low pressure passage 68 communicates with the innermost portion 40 of cavity 14 and the high pressure passage 24 communicates with either unthreaded portion 36 or sealing portion 38 at a location separated from the low pressure fluid by seals 56 and 58. Normally open switch 10, for example, is threaded into cavity 14 to compress O-ring 34. Assuming housing 16 is part of a filter 12, filter 12 is installed as appropriate on an assembly. Appropriate external circuitry including, for example, a signal light 84 and a battery 86 is wired in series between post 18 and housing 16 as shown in FIG. 8. As oil is cleaned and filter 12 begins to accumulate foreign particulate matter, a differential pressure is developed cross the filter material. Similarly, low and high pressure fluids are separated in cavity 14 by seals 56 and 58. That is, high pressure fluid is in communication with cavity 14 through passage 24 and flows around piston 22 to seal 58 and, also, flows through grooves or slots 48 and into opening 42 along post 18 to seal 56. At an appropriate differential pressure, the force on piston 22 overcomes spring 26 whereby piston 22 moves away from nut 28 and ring 60 contacts wall 76 of housing 16. A conductive path is then formed between post 18 and housing 16 through clip 66, spring 26 and ring 60 thereby completing the circuit to light 84 and alerting the operator that the filter is becoming clogged.

The embodiment of switch 10′ is used similarly except the conductive path between post 18′ and housing 16′ is formed differently as discussed hereinbefore.

Figure 6:
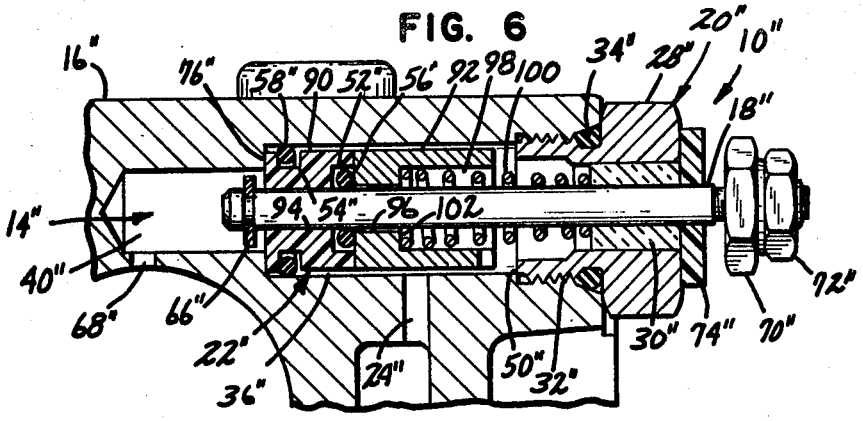
FIG. 6 is a cross-sectional view similar to FIG. 2 showing another alternate embodiment switch.
Figure 7:
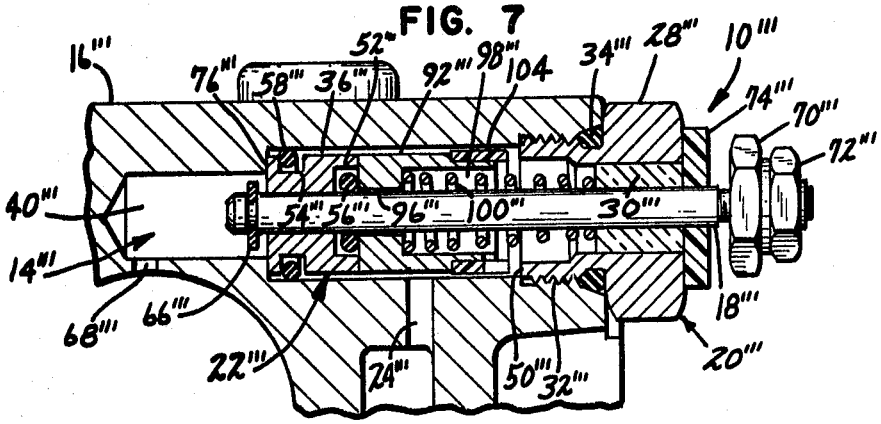
FIG. 7 is a cross-sectional view similar to FIG. 2 showing yet another alternate embodiment switch.

In a further embodiment, FIGS. 6 and 7 show switches wherein high pressure fluid communicates with the innermost portions of the cavity while lower pressure fluid communicates with intermediate portions. Many of the elements of the switches of these embodiments are similar to the elements of switch 10 and are identified by similar numbers although distinguished with double or triple primes.

As shown in FIG. 6, switch 10″ includes a post 18″ with a support mechanism 20″ similar to that of switch 10 in FIG. 2. Switch 10″ is threaded into cavity 14″ which includes three portions instead of four as in the previously discussed embodiments. In cavity 14″ there need not be a difference in diameter between a sealing portion and an unthreaded portion.

A piston 90 and a spacer 92 have outer diameters somewhat smaller than unthreaded portion 36″ of cavity 14″ and have inner openings 94 and 96 for receiving post 18″. A larger opening 98 concentric with post 18″ is formed in the end portion of spacer 92 facing nut 28″. A coil spring 100 is partially received within opening 98 and compressed between insulating glass 30″ and wall 102 which separates openings 96 and 98 in spacer 92.

Piston 90 includes a pair of seals 56″ and 58″ similar to those of FIG. 2 except gland 52″ abuts spacer 92 so that the bottom of spacer 92 forms a sidewall for gland 52″.

In operation, switch 10″ is wired into a circuit similar to that of FIG. 8. Coil spring 100 forces spacer 92 against piston 90 which is forced against shoulder 76″, the wall between innermost portion 40″ and unthreaded portion 36″ of cavity 14″. In the normally open switch of 10″, piston 90 is made from an insulating material while spacer 92 is conductive. Spring 100 is also conductive and has one of its coils tightly squeezed about post 18″ to form good electrical contact. When the high pressure fluid in the innermost portion 40″ of cavity 14″ overcomes spring 100, piston 90 and spacer 92 move until spacer 92 contacts nut 28″. A conductive path is then formed between post 18″ and housing 16″ through spring 100, spacer 92 and nut 28″.

A switch 10‴ in the embodiment of FIG. 7 is similar to switch 10″ of FIG. 6 except switch 10‴ is normally closed. Switch 10‴ is different from switch 10″ in that both piston 22‴ and spacer 92‴ are conductive, and an insulating ring 104 has been added to fit within a cylindrically removed portion near the end of spacer 92‴ facing nut 28‴. Ring 104 extends beyond the end of spacer 92‴ to prevent spacer 92‴ from contacting conductive nut 28‴. In its normally closed configuration, a conductive path is formed between post 18‴ and housing 16‴ through spring 100‴, spacer 92‴ and piston 22‴. When high pressure fluid in innermost portion 40‴ of cavity 14‴ overcomes spring 100‴, piston 22‴ and spacer 92‴ move so that spacer 92‴ contacts nut 28‴ thus opening the conductive path between wall 76‴ and 22‴.

Thus, the present invention, disclosed in a number of embodiments, provides for a switch which may be used as an inexpensive replacement for apparatus providing a similar function but requiring additional housings and elements. The present switch is advantageously small and fits particularly well within cavities in heads of hydraulic filters.

The various configurations of the invention provide for normally open and normally closed electrical configurations as well as configurations wherein high and low pressure fluids act at different locations on the switch. This versatility, combined with the fact of low part and installation cost, result in the importance of the present invention.

The present disclosure has, thusly, provided numerous characteristics and advantages of the present invention together with details of structure and function. It is to be understood, however, that the disclosure is illustrative only, and any changes made, especially in matters of shape, size and arrangement, to the full extent extended by the general meaning of the terms in which the appended claims are expressed, are understood to be within the principle of this invention.

I claim:

1. Switch apparatus in combination comprising:
   - a housing connected electrically to ground, said housing having a cavity therein;
   - a post connected conductively to an electrical source;
   - means for supporting said post cantilevered within the cavity, said supporting means including means for sealing said cavity between said post and said housing;
   - means for communicating high pressure fluid to said cavity;
   - means for communicating low pressure fluid to said cavity;
   - means, guided by said post, for maintaining separation between said high and low pressure fluids within said cavity;
   - means for biasing said separation maintaining means against said high pressure; and
   - means for disconnectably connecting electrically said post and said housing.

2. An apparatus in accordance with claim 1 wherein said separation maintaining means includes a piston with a central opening therethrough for receiving said post, said piston retaining first means for sealing between said piston and said post and second means for sealing between said piston and said housing.

3. An apparatus in accordance with claim 2 wherein said piston has inner and outer walls concentric with said post and a wall of said cavity, said outer wall being spaced farther from the wall of said cavity than spacing between said inner wall and said post to minimize binding of said piston between said post and the wall of said cavity.

4. A differential pressure switch for installation in a cavity of a grounded housing, said housing including means for communicating high and low pressure fluid into the cavity, said switch comprising:
   - a central post for connection to an electrical energy source, said post having outer and inner ends;
   - means for sealably fastening said post near the outer end to said housing, said fastening means providing support to cantilever the inner end of said post within said cavity; and
   - means, mounted on the cantilevered portion of said post, for disconnectably connecting electrically said post and said housing, said connecting means including means for separating the high and low pressure fluids in said cavity.

5. A switch in accordance with claim 4 wherein said connecting means includes a compression spring received about said post between a top on said post and a slidable conductive member.

6. A switch in accordance with claim 4 wherein said separating means includes a piston received about and movable along said post, said piston having first means for sealing between said post and said piston and second means for sealing between said housing and said piston.

7. A switch in accordance with claim 6 wherein said piston is one of a conductor and an insulator, said piston as a conductor being at least a part of a disconnectable electrical path between said post and said housing, said piston as an insulator preventing electrical contact between said post and said housing.

8. A switch in accordance with claim 6 wherein said first and second sealing means each includes an O-ring spaced apart from a bottom in a gland for containing said O-ring, whereby said O-ring functions as a low friction wiper rather than being compressed between the bottom of said gland and an opposing wall.

9. A switch in accordance with claim 6 wherein said first and second sealing means each include a rectangular cross-section ring retained within a gland on said piston and contacting a wall opposite said gland.

10. A differential pressure switch for installation in a cavity of a grounded housing, said housing including first and second means for communicating first and second fluids into the cavity, said switch comprising:

a terminal post for connection to an electrical energy source;

means for supporting said post to cantilever an end of said post within the cavity, said supporting means including a threaded plug with first means for sealing between said housing and said plug, said supporting means including means for electrically insulating said plug from said post;

a piston with a central opening therethrough for receiving said post, said piston retaining second means for sealing between said piston and said post and third means for sealing between said piston and said housing, said piston being mounted on said post between said first and second fluid communicating means;

means for disconnectably forming an electrical path between said post and said housing, forming means including a spring received about said post;

whereby differential pressure between the first and second fluids on opposite sides of said second and third sealing means causes movement of said piston thereby causing the conductive path of said forming means to be one of open and closed.

11. A switch in accordance with claim 10 wherein said piston is an electrical conductor, and wherein said spring is located between a fixed, conductive retainer near the cantilevered end of said post and said piston, said spring being conductive and forming a portion of the conductive path.

12. A switch in accordance with claim 11 wherein said spring is a coil spring for forcing said piston against said plug to make a first electrical contact, said switch including an insulating stop member between said piston and said housing to prevent a second electrical contact between said piston and said housing when the high pressure fluid moves said piston to compress said spring.

13. A switch in accordance with claim 10 wherein said spring is compressed between a retaining member fixed on said post and a movable conductive member received about said post, whereby when the high pressure fluid moves said piston to compress said spring, the electrical path is formed between said post and said housing through said spring and said movable conductive member.

14. A switch in accordance with claim 10 wherein said forming means includes a conductive movable member between said spring and said piston, said spring and said piston being conductive to form a first conductive path through said spring, said movable member and said piston, said switch including an insulating member received about one of said piston and said movable member to prevent a second conductive path.

15. A differential pressure switch for installation in a cavity of a grounded housing, said housing including means for communicating high and low pressure fluid into the cavity, said switch comprising:

a central post for connection to an electrical energy source;

means for supporting said post cantilevered within the cavity, said supporting means including means for sealing said cavity between said post and said housing;

means, supported by said post, for separating said high and low pressure fluids within said cavity; and means for disconnectably closing a conductive path between said post and said grounded housing, said closing means including first and second movable members mounted on said post and means for biasing said members for disconnectably closing the conductive path through one of said first and second members, said biasing means being received about said post.

16. A switch in accordance with claim 15 wherein said first movable member is conductive and said second movable member is nonconductive and wherein said biasing means includes a compression spring about said post between said supporting means and said first movable member, whereby when said spring is extended, the first movable member is separated from a conductive portion of said supporting means in contact with said housing thereby opening the conductive path to said post.

17. A switch in accordance with claim 15 including a nonconductive ring about said first movable member and extending beyond a first end of said first movable member, said first and second movable members being conductive, said biasing means including a conductive compression spring about said post between said supporting means and said first movable member, a first conductive path being formed between said post and said housing through said spring and said first and second movable members, a second conductive path between said post and said housing being prevented by said nonconductive member.

18. A switch in accordance with claim 15 wherein said biasing means includes a compression spring about said post between a fixed retainer near the cantilevered end of said post and said movable members.

19. A switch in accordance with claim 15 including a second movable member, one of said first and second movable members being conductive and the other being nonconductive, said nonconductive movable member preventing a second conductive path when high pressure fluid causes said switch to change state.

20. A differential pressure switch for installation in a cavity of a grounded housing, said housing including means for communicating high and low pressure fluid into the cavity, said switch comprising:

a central post for connection to an electrical energy source;

means for supporting said post to cantilever an end of said post within the cavity, said supporting means including a threaded plug with first means for sealing between said housing and said plug, said supporting means including means for electrically insulating said plug from said post;

a piston with a central opening therethrough for receiving said post, said piston retaining second means for sealing between said piston and said post and third means for sealing between said piston and said housing;

a spacer with a central opening therethrough for receiving said post, said spacer being between said piston and said plug;

a coil spring about said post between said supporting means and said spacer for biasing said piston and said spacer against high pressure fluid; and one of said piston and said spacer being conductive and the other being nonconductive;

whereby said switch has a first state with a conductive path between said post and said housing and a second state wherein said post is insulated from said housing.

* * * * *

UNITED STATES PATENT AND TRADEMARK OFFICE

CERTIFICATE OF CORRECTION

PATENT NO. : 4,480,160

DATED : October 30, 1984

INVENTOR(S) : Jack Stifelman

It is certified that error appears in the above-identified patent and that said Letters Patent is hereby corrected as shown below:

Column 4, line 57, delete "cross" and insert therefor --across--.

Column 7, line 1, claim 5, delete "top" and insert --stop--.

Signed and Sealed this

*Sixteenth* Day of *April 1985*

[SEAL]

*Attest:*

DONALD J. QUIGG

*Attesting Officer*

*Acting Commissioner of Patents and Trademarks*